US005215219A

United States Patent [19]

Gallagher

[11] Patent Number: 5,215,219

[45] Date of Patent: Jun. 1, 1993

[54] INTERNAL PIERCE POINT CONTAINER HAVING AN AXIALLY MOVABLE PIERCER

[75] Inventor: John A. Gallagher, Philadelphia, Pa.

[73] Assignee: CP Packaging, Inc., Jameburg, N.J.

[21] Appl. No.: 828,517

[22] Filed: Jan. 31, 1992

[51] Int. Cl.[5] ..... B67B 7/46

[52] U.S. Cl. ..... 222/83; 222/541

[58] Field of Search ..... 222/80-89, 222/106, 206, 541; 215/201, 246, 250, 252

[56] References Cited

U.S. PATENT DOCUMENTS

| | | | |
|---|---|---|---|
| 1,913,807 | 6/1933 | Jones | 222/81 |
| 3,204,819 | 9/1965 | Gurtler | 222/82 X |
| 3,255,923 | 6/1966 | Soto | 222/81 X |
| 3,442,424 | 5/1969 | Prussin et al. | 222/81 |
| 3,506,008 | 4/1970 | Huck | 222/81 X |
| 4,017,007 | 4/1977 | Riccio | 222/80 |
| 4,019,654 | 4/1977 | van Manen | 222/80 X |
| 4,589,572 | 5/1986 | Pomarolli | 222/83.5 |
| 4,651,885 | 3/1987 | Gach | 222/541 X |
| 4,867,326 | 9/1989 | O'Meara | 215/250 |

FOREIGN PATENT DOCUMENTS

| | | | |
|---|---|---|---|
| 1295834 | 11/1972 | United Kingdom | 222/81 |

*Primary Examiner*—Andres Kashnikow
*Assistant Examiner*—Kenneth DeRosa
*Attorney, Agent, or Firm*—Eugene E. Renz, Jr.

[57] ABSTRACT

A tube assembly for medicament and the like wherein the contents can be discharged by squeezing the tube. The tube assembly includes a nozzle having a discharge port and an axial central bore with a diaphragm extending across the bore at the inner end of the discharge port. A piercer unit mounted in the nozzle portion is mounted for axial movement in the central bore from a first readily position, axially inwardly of the thin wall, to a second discharge position puncturing the diaphragm. The assembly further includes a cap having a support plug sized in the discharge port for abutment against the diaphragm and to prevent inadvertent puncture thereof. The piercer unit includes a hollow needle-like member adapted for movement axially in the central bore and a piston for mounting the hollow needle-like member slidably in the nozzle portion for actuating the needlelike member from the first position to the second position upon application of external pressure, such as squeezing pressure applied to the tube.

10 Claims, 1 Drawing Sheet

INTERNAL PIERCE POINT CONTAINER HAVING AN AXIALLY MOVABLE PIERCER

FIELD OF THE INVENTION

The present invention relates to a device for containing and dispensing medicaments and other contents, and more particularly to a device in which access to the contents is prevented until a seal is punctured. In its simplest form, the invention relates to a novel puncture mechanism which operates from within a tube.

BACKGROUND OF THE INVENTION

The field of cap and tube assemblies which carry medicines, vitamins and the like, has become of major importance and interest in the pharmaceutical industry. It is a growing need that container assemblies be difficult for children to open, particularly accidentally. Also, increased interest is being shown in cap and tube assemblies which cannot be opened by happenstance but which require a specific and positive step to be taken in order to have access to the contents. This is particularly true when medicines, vitamins and topical treatments such as eye drops are contained in such tubes.

It is also important that it be easy and certain to determine if there has been access to the contents. This is normally referred to as a "tamper evident" feature, although in many cases the primary function is to provide an inspection means which verifies the integrity of the contents. Most concern is not for tampering, which can be serious if not deadly but which is very rare in actuality. At best, tamper evidence means that the one attempting to tamper has not done that which is obvious, such as breaking a visible seal or the like.

More common as a concern is the need to be sure that the contents are pure and have not been contaminated by the environment. In many tube assemblies, the outside environment can and does come in contact with the discharge end of the tube and also with the part of the tube out of which the sterile contents will flow. No matter how sterile the container, if it pours over contaminated surfaces the contents will also be contaminated.

In prior art devices, tube assembly designs have been proposed which include a three piece construction where a tube body contains a plug attached to a portion of the main body of the tube. The wall of the tube has been weakened sufficiently to permit the plug to be torn from the tube. A cap portion is designed so that one end might be fitted over the tube having the plug, thereby protecting the plug and tube. The other end is then designed to interact with the plug in a twisting manner to remove the plug by rupturing the thin wall of the tube to which the plug is attached. This design has not been effective, however, because of the additional concern caused by the existence of the plug and the need for safe and reliable disposal of the plug.

In U.S. Pat. No. 4,867,326, a child-resistant cap and tube assembly is shown which has a high reliability in pass/fail inspection opportunities. This design permits easy inspection of unit dose sterile medicaments.

This prior device has a tube which has one end portion terminating in an axially centered first opened surface at the outer perimeter of the end portion. Recessed below the surface of the end portion is a thin wall which seals the tube. The tube has a second surface, called a surface of interference, which operates to interfere with axial movement on the end portion. The cap has a resistance surface which engages the end to locate the cap at a first position where the thin wall portion on the tube is protected. Movement overcoming the restraining efforts of the two surfaces causes a piercer to move to then puncture the thin wall and provide access to the contents.

The prior device in U.S. Pat. No. 4,867,326 has been highly effective in keeping children and others from inadvertently opening the container and causing loss or damage to the contents. It is also suitable for a pass/fail inspection step as the thin wall is clearly visible when the cap is removed. The condition of the thin wall is easily determined visually.

In the prior system, axial activation force was all that was needed to overcome the engagement between the resistance surface and the surface of interference. Once this is overcome for whatever reason, the piercer moves to the second position as described in that patent and the thin wall seal which has been protecting the contents is pierced. That is desirable only when the user makes that decision and not merely because the force has been overcome inadvertently.

It is therefore an object of this invention to provide a child-resistant tube and cap assembly that requires more than axial force to provide access to the contents.

In any system including those described above, when the piercing agent enters the container from the outside, there is always the potential that the piercer will bring contamination with it. Even in the systems described above, the sterile conditions are maintained nicely only when the cap is never removed from the tube nozzle until after it is intentionally activated. Under many circumstances, this is fine, but when visual inspection of the thin wall membrane is desired, such as when there is suspicion that the tube assembly has been in the hands of children or other unauthorized persons, it is comforting to inspect the thin wall visually. When the cap is removed to do this step, the possibility for contamination exists.

Accordingly, it is an object of this invention to provide a device which is capable of providing not only child-resistance but also a quick visual warning or sign that the device has in fact been opened.

It is another object of this invention to provide an activation system which permits visual inspection without the possibility that the piercing member will be contaminated.

It is primary object of this invention to provide a simple and effective design for permitting sanitary and sterile access to the contents of a tube assembly without the possibility of the piercing agent entering into the tube after assembly.

Other objects will appear hereinafter.

SUMMARY OF THE INVENTION

It has now been discovered that the above and other objects of present invention may be accomplished in the following manner. Specifically, a tube assembly has been discovered which is admirably suited for containing medicines and the like and which is designed for dispensing the contents upon squeezing the tube.

The assembly comprises a tube having a discharge end with an axially aligned nozzle extending from the tube to a discharge port. Typically, tubes of this type are used for medicines, vitamins, eye drops, and the like, but any tube can employ the present invention, particularly those tubes which are to be sterile or at the least very clean and free from contamination. The present invention is also particularly useful when tamper evident features are desired, as all of the operating mechanisms are located inside the tube and any opening is easily seen upon visual inspection.

The nozzle has an axially aligned central bore with a thin wall sealing the central bore at a point recessed from the exposed end of the nozzle. Also included is a piercer means which is mounted in the nozzle. The piercer means is sized to slideably move axially in the central bore from a first ready position axially inward of the thin wall to a second discharge position in which the piercer has completely puncturing the thin wall. It is preferred that the piercer means is sized to be inserted into the discharge port from the filling end of the tube prior to the filling tube.

In the first position, the piercer, which preferably comprises a hollow needle-like member, is located in a first position which is a safe distance from the thin wall. The hollow needle-like member is sized to move axially in the central bore and is mounted on a piston which is sized to slideably fit in the discharge port and move the needle-like member from the first position to the second position upon application of pressure to the tube. Because the application of the pressure is not axial, but rather comes from squeezing the tube, the possibility of inadvertent axial force causing an undesired puncture of the protective thin wall is eliminated.

Most commonly, the assembly also includes a cap mounted on the exterior of the nozzle. The cap provides additional protection for the contents and specifically keeps the discharge port free from contamination. It may be desirable to include tamper evident features to the manner in which the cap and tube are mounted on the exterior of the nozzle portion.

Of primary importance when a cap is employed is the use of an axially centered support member which is sized to fit in the discharge port. This axially centered support plug is sized to fit in the discharge port for abutment against the recessed thin wall and prevent inadvertent puncture of the thin wall. Thus even if the tube is squeezed, the internal pressure is not enough to cause the piercer means to puncture the thin wall because the thin wall is effectively made much thicker with the support plug in mating contact with the wall via its flat, axially transverse surface.

BRIEF DESCRIPTION OF THE DRAWINGS

For a more complete understanding of the invention, reference is hereby made to the drawings, in which.

DETAILED DESCRIPTION OF THE PREFERRED EMBODIMENT

Figure 2:
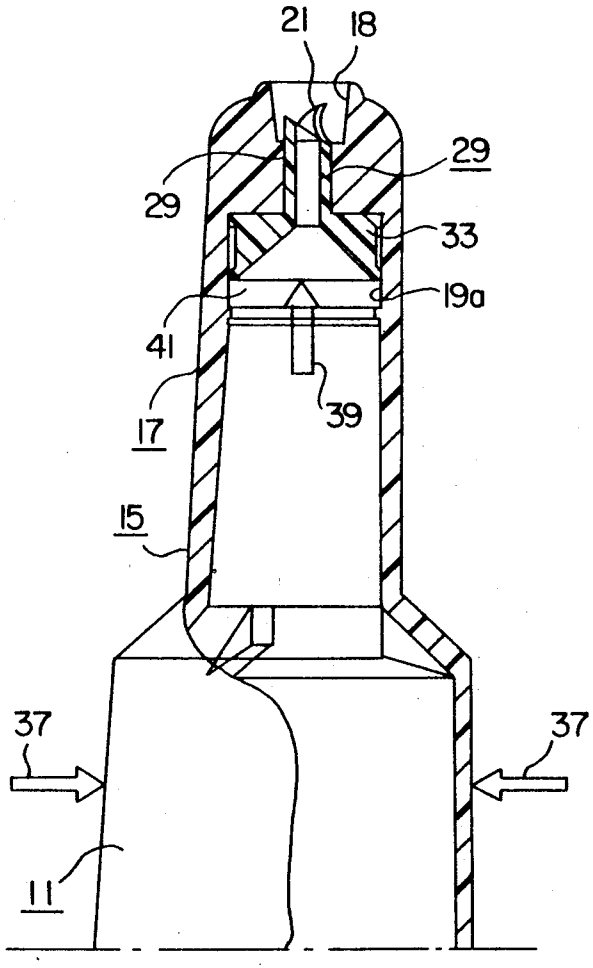
FIG. 2 is a view similar to FIG. 1, showing the internally actuated pierce point having pierced the thin wall forming a nozzle diaphragm under hand discharge pressure.

As shown in the drawings, the tube assembly of the present invention is shown generally by the reference numeral 10. The assembly includes a tube 11 having a filling end of conventional design at the bottom of the tube 11. Tube 11 also includes a discharge end 15. The filling end allows for the piercing mechanism of the present invention to be inserted into tube 11 prior to placing the contents into the assembly. As has been noted, any product such as medicines, vitamins, eye drops or other products are suitable for use with the present invention. The filling end is sealed in a conventional manner, often by heat seal, after the contents have been placed in the tube.

A nozzle portion 17 is mounted on the discharge end 15 of tube 11 and includes a discharge port 18 which has a central bore 19. A thin wall 21 or diaphragm is located in central bore 19 at a predetermined point which is recessed from the exposed end 23 of discharge port 18.

In a preferred embodiment, the invention includes a cap 25 which is shown in friction fit on nozzle portion 17 of the discharge end 15 of tube 11. Cap 25 is preferably fit on the nozzle portion 17 using a friction fit for economy of manufacture, but it is also possible to use threaded fittings, ring and groove means for fastening caps and tubes, or other such mechanisms which hold the cap 25 on the nozzle 17. Located on the inside of cap 25 is an axially centered support member 27 which is shown in the shape of a plug having an axially transverse, flat face 28.

It is of primary importance to hold the plug 27 in place as the plug 27 is sized to present flat, axially transverse surface 28 across the entire external face of the thin wall 21. In this embodiment, the plug 27 is normally in contact with the thin wall 21 when the cap 25 is mounted on the exterior of the nozzle portion 17.

Located inside the tube 11 is a piercer means 29 which is in the form of a hollow piercer 29 sized to move axially in central bore 19. Piercer 29 is hollow, having an axially centered bore 31 through which the contents will be passing when the device is activated. The piercer means 29 also includes a piston member 33 which functions to mount the hollow piercer member 29. Piston member 33 is sized to slideably fit in the central bore **19*a* of discharge port 18 and is adapted to move the piecer 29 from a first position shown in FIG. 1 to a second position shown in FIG. 2 after cap 25 has been removed and there has been application of pressure to tube 11**.

When piston 33 and piercer 29 are inserted into tube 11, such as through filling end 13, the piercer 29 is aligned with and moved into central bore 19. The diameter of piston 33 is the same as the inside diameter of nozzle portion 17 where the piston 33 thus will function as a piston. The piston 33 and piercer 29 are molded in one piece and can be easily inserted using automated filling equipment.

Figure 1:
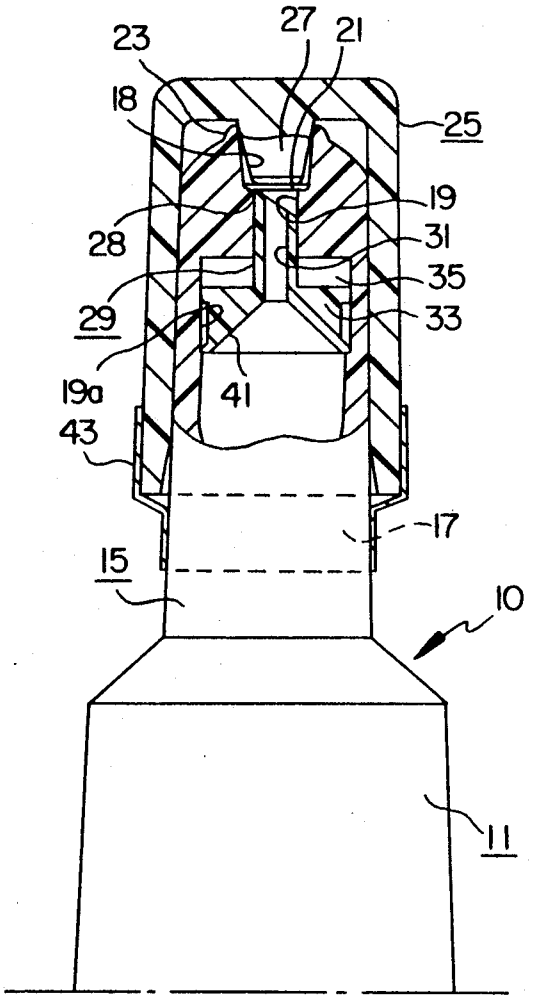
FIG. 1 is an enlarged, fragmentary elevational view at the upper or discharge portion of a molded plastic tube having an internally actuated pierce point device.

The contents are added to tube 11 after this step so that no contents are present in space 35 which exists on the discharge side of piston 33 when piston 33 is in the position shown in FIG. 1. Piston 33 is positioned in this first position which can be described as a ready to use position. Plug 27 has plug face 28 across the entire surface of thin wall 21 and prevents piercer 29 from puncturing thin wall 21. During normal filing operations the force of filling is not sufficient to cause piercer 29 to damage thin wall 21.

When cap 25 is removed, as shown in FIG. 2, the restraining force of plug face 28 is also removed. Application of pressure to tube 11 by squeezing in the direction of arrows 37 causes the contents to move in the direction of arrow 39 up against the tapered inside surface 41 of piston 33. This movement of contents forces piston 33 to compress the small amount of air trapped in space 35 as the piston 33 and piercer 29 move in the direction of arrow 39 along central bore 19 and puncture thin wall 21. The hydraulic forces on piston 33 are sufficient to cause the piston to move to that position shown in FIG. 2 and the contents can be used as intended.

The cap 25 shown in FIG. 1 is press fit or friction fit on nozzle portion 17 and can easily be removed to allow visual inspection of thin wall 21. The cap 25 can then be replaced until it is time to use the tube. Alternatively, cap 25 could be attached to nozzle portion 17 by a tamper evident band 43. Band 43 can function to alert the user that the cap 25 has been removed and band 43 can also provide additional protection against inadvertent removal of cap 25 as well as insuring that plug 27 remains in position against thin wall 21.

While particular embodiments of the present invention have been illustrated and described, it is not intended to limit the invention, except as defined by the following claims.

I claim:

1. A tube assembly, comprising:

a tube having a nozzle portion including a discharge port having inner and outer ends, said nozzle portion having an axially aligned central bore with a thin wall sealing said central bore at the inner end of said discharge port;

piercer means mounted in said nozzle portion and sized to move axially in said central bore from a first ready position, axially inwardly of said thin wall, to a second discharge position puncturing said thin wall; and a cap mounted on the exterior of said nozzle portion having an axially centered support member sized to fit in said discharge port for abutment against said recessed thin wall.

2. The assembly of claim 1, wherein said piercer means includes a hollow piercer member sized to move axially in said central bore, said piercer means also including a piston member for mounting said hollow piercer member and sized to slideably fit in said nozzle portion and adapted to move said piercer member from said first position to said second position upon application of pressure to said tube.

3. A cap and tube assembly, comprising:

a tube having a nozzle portion at one end and a discharge port in said nozzle portion having inner and outer ends, said nozzle portion having an axially aligned central bore with a thin wall sealing said central bore at the inner end of said discharge port;

a cap mounted on the exterior of said nozzle portion, said cap having an axially centered support member sized to fit in said discharge port for abutment against said recessed thin wall; and piercer means mounted in said nozzle portion, said piercer means including a hollow piercer member sized to move axially in said central bore from a first ready position, axially inward of said thin wall, to a second discharge position puncturing said thin wall, said piercer means also including a piston member for mounting said hollow piercer member and sized to slideably fit in said nozzle portion and adapted to move said piercer member from said first position to said second position upon application of pressure to said tube.

4. The assembly of claim 3, wherein said hollow piercer member engages said central bore at said first position prior to filling said tube to prevent contents from opposing said piston member upon application of pressure to said tube.

5. The assembly of claim 4, wherein said support member in said cap includes plug means sized to present a flat, axially transverse surface across the external face of said thin wall, said plug means being normally in contact with said thin wall when said cap is mounted on the exterior of said nozzle portion.

6. The assembly of claim 5, which further includes a tamper evident band removably holding said cap on said nozzle portion.

7. The assembly of claim 5, wherein said piston member includes an axially aligned, inward facing tapered surface for guiding contents to said hollow piercer member.

8. A cap and tube assembly, comprising:

a tube having a nozzle portion at one end and a discharge port in said nozzle portion having inner and outer ends, said nozzle portion having an axially aligned central bore with a thin wall sealing said central bore at the inner end of said discharge port;

a cap mounted on the exterior of said nozzle portion, said cap having an axially centered support member sized to fit in said discharge port for abutment against said recessed thin wall; and piercer means mounted in said nozzle portion, said piercer means including a hollow piercer member sized to move axially in said central bore from a first ready position, axially inward of said thin wall, to a second discharge position puncturing said thin wall, said piercer means also including a piston member for mounting said hollow piercer member and sized to slidable fit in said nozzle portion and adapted to move said piercer member from said first position to said second position upon application of pressure to said tube said piercer means being sized to be inserted into said nozzle portion of said tube to prevent contents from opposing said piston member upon application of pressure to said tube.

9. The assembly of claim 8, wherein said support member in said cap includes plug means sized to present a flat, axially transverse surface across the entire external face of said thin wall, said plug means being normally in contact with said thin wall when said cap is mounted on the exterior of said nozzle portion.

10. The assembly of claim 9, which further includes a tamper evident band removably holding said cap on said nozzle portion.

* * * * *